United States Patent [19]

Silvestri

[11] 4,273,380

[45] Jun. 16, 1981

[54] BEACH ACCESSORY

[76] Inventor: Margaret W. Silvestri, 18 Arbor Ct., Peabody, Mass. 01960

[21] Appl. No.: 70,302

[22] Filed: Aug. 27, 1979

[51] Int. Cl.[3] ..... A47C 31/10

[52] U.S. Cl. ..... 297/191; 297/229

[58] Field of Search ..... 297/191, 219, 229; 5/417-420

[56] References Cited

U.S. PATENT DOCUMENTS

| | | | |
|---|---|---|---|
| 2,105,319 | 1/1938 | Hedden et al. | 5/419 X |
| 2,227,180 | 12/1940 | Falk | 297/229 X |
| 2,270,598 | 1/1942 | Morgan | 297/191 |
| 2,883,682 | 4/1959 | Kwake | 5/419 |
| 2,898,609 | 8/1959 | Storie | 5/419 |
| 2,910,707 | 11/1959 | Lawser et al. | 5/419 |
| 3,014,759 | 12/1961 | Bing | 297/191 |
| 3,176,315 | 4/1965 | Freund | 5/417 X |
| 3,879,775 | 4/1975 | Iwata | 5/420 |
| 3,976,113 | 8/1976 | Kim | 5/417 |
| 4,097,944 | 7/1978 | Yulish | 5/419 |

FOREIGN PATENT DOCUMENTS

| | | | |
|---|---|---|---|
| 174850 | 2/1922 | United Kingdom | 297/191 |
| 514644 | 11/1939 | United Kingdom | 297/229 |

*Primary Examiner*—Francis K. Zugel

[57] ABSTRACT

A beach accessory in the form of a combined beach towel—chair cover—tote bag, comprising an elongated strip of absorbent towelling having pockets on its opposite major surfaces at one end, at least one of said pockets being large enough to store the entire length of towelling not covered by the pockets, the pockets opening inwardly of the towelling and having stringing through casings along their free edges to allow closure thereof to form a tote bag for said towelling and other articles to be carried.

5 Claims, 7 Drawing Figures

BEACH ACCESSORY

BACKGROUND OF THE INVENTION

This invention relates to beach accessories.

Various beach accessories have been in use over the years; these include mats of various sorts, towels, chair covers, and tote bags.

SUMMARY OF THE INVENTION

The invention provides a combined beach towel—chair cover—tote bag, which is easily and inexpensively manufactured, attractive in appearance, and yet highly and conveniently functional in each of its three aspects.

In general, in one aspect, the invention features an elongated strip of absorbent towelling having pockets on its opposite major surfaces at one end, at least one of the pockets being large enough to store the entire length of towelling not covered by the pockets, the pockets opening inwardly of the towelling and having stringing through casings along their free edges to allow closure thereof to form a tote bag for the towelling and other articles to be carried.

In another aspect the invention features such towelling with a towel storage pocket at one end and tucks along its sides to fit the back of a chair.

In preferred embodiments one of the pockets is partitioned by stitching.

The invention also features a construction method. In general, a short piece of towelling is superimposed on one end of, and sewn to, a long piece of towelling; both the short piece and the end of the long piece on which it is superimposed are then folded along the stitch line and sewn along their sides to the sides of the adjacent portion of the long piece; and the outer one of the resulting pockets is then turned inside out to leave pockets on opposite major surfaces of the long piece at the same end.

DESCRIPTION OF THE PREFERRED EMBODIMENTS

We turn now to the construction and use of the invention, first briefly describing the drawings.

DRAWINGS

CONSTRUCTION

Figure 1:
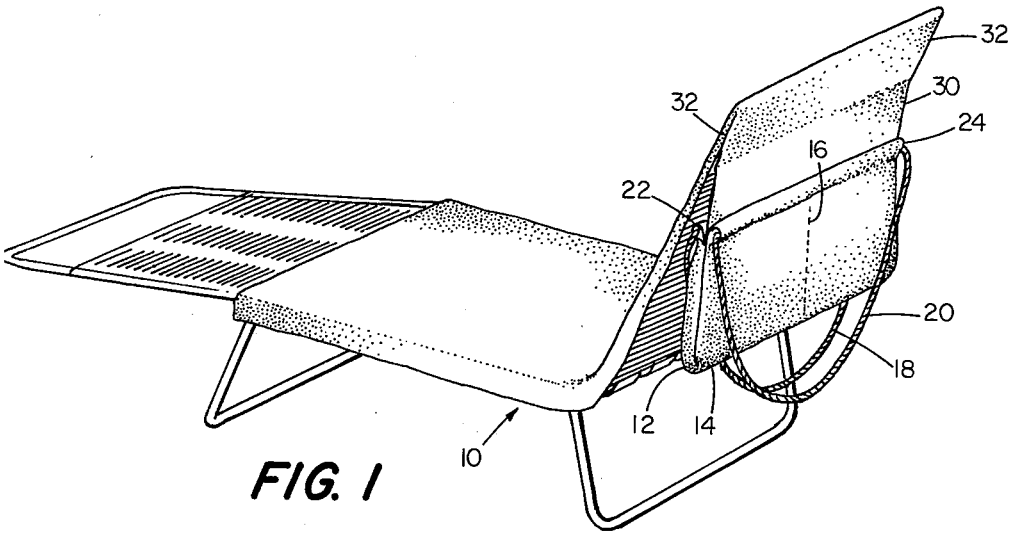
FIG. 1 is a perspective view of the preferred embodiment in use as a fitted chaise lounge cover.
Figure 2:
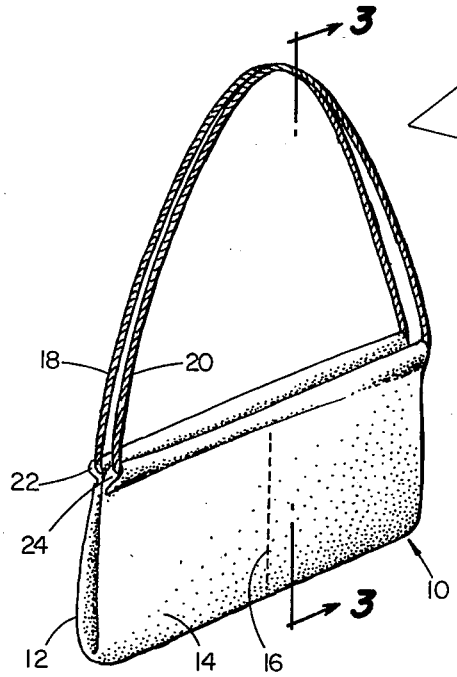
FIG. 2 is a view of the preferred embodiment in use as a tote bag.
Figure 4:
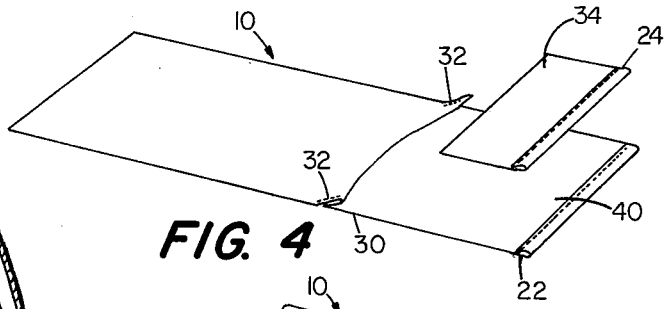
FIGS. 4–7 illustrate, somewhat schematically, various stages in the construction of the preferred embodiment.
Figure 5:
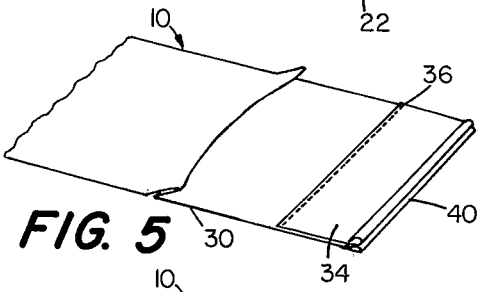
Figure 6:
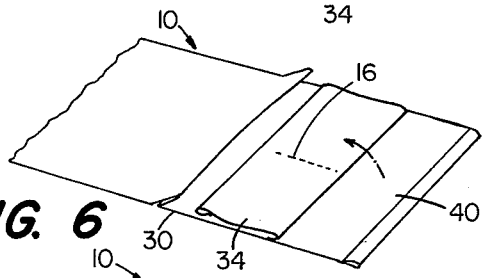
Figure 3:
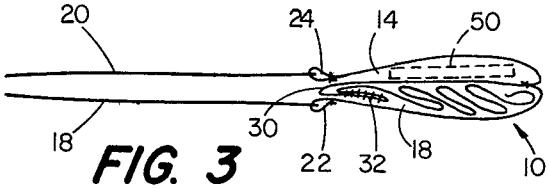
FIG. 3 is a sectional view taken along 3—3 of FIG. 2.
Figure 7:
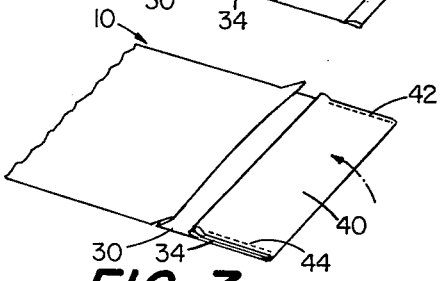

Referring to FIGS. 1–3, the preferred embodiment is a beach accessory in the form of a combination beach towel—chair cover—tote bag, consisting of a towel 10 having pockets 12 and 14 on opposite sides at one end. Pocket 14 is divided in half by stitching 16. Drawstrings 18 and 20 pass through casings 22 and 24 at the upper edges of the pockets.

To construct the accessory, a 90″×27″ piece 30 of towelling (typically knit terry, or looped towelling) is sewn to provide 1½″ long tucks or darts 32 at opposite sides, and casing 22 at one end. The darts are 13″ from casing 22. A 12″ long piece 34 of towelling, also 27″ wide, is sewn to provide casing 24 and is then sewn to piece 30 along line 36, so that the two casings are aligned. Piece 34 is then folded over line 36 and stitched at 16 (along its midline) to piece 30. End 40 of piece 30 is then folded at line 36 over piece 34, and all three now superimposed layers of towelling are sewn together along their edges at 42 and 44. The outer pocket thus formed between end 40 and piece 34 is now turned inside out, and drawstrings 18 and 20 are added to provide the finished product. This method of construction is not only convenient, but hides most of the stitching.

In use, the accessory may be placed flat on a beach, or may be used as a chaise lounge cover as shown in FIG. 1, with the pockets serving for storage, and may be formed into a tote bag (FIGS. 2 and 3) by stuffing the towel into pocket 12. Other articles, indicated at 50 in FIG. 3 may be stored in divided pocket 14.

When the accessory is in use as a flat beach towel, the pockets may function for storage, or may be turned over and stuffed for use as a pillow.

When in use as a chaise lounge cover, the tucks hold the accessory firmly in place on the chair. Further, the provision of pockets on both sides of the towel allows items to be hidden from view in pocket 12.

The drawstrings may of course by drawn tight when the accessory is used as a tote bag.

Other embodiments are within the scope of the following claims.

I claim:

1. A beach accessory in the form of a combined beach towel—chair cover—tote bag, comprising an elongated strip of absorbent towelling having substantially superimposed pockets on its opposite major surfaces at one end, at least one of said pockets being large enough to store the entire length of towelling not covered by the pockets, said pockets opening inwardly of the towelling and having stringing through casings along their free edges to allow closure thereof to form a tote bag for said towelling and other articles to be carried, said free edges, when said stringings therein are not under tension, running perpendicular to the longitudinal axis of said towelling and being of substantially the same length as the width of said towelling adjacent said free edges, said accessary further comprising tucks in said towelling near said pockets, said tucks defining the corners of a fold adapted to fit said accessory to the back of a chair or chaise lounge, while allowing said pockets to hang from said back to provide storage, said tucks being short enough and said fold being narrow enough to allow said accessory to be placed substantially flat on a flat surface.

2. The accessory of claim 1 wherein three layers of said towelling are superimposed at said one end to form said pockets, one outer layer being stitched to the middle layer to divide one of said pockets.

3. The accessory of claim 2 wherein two of said layers are integral portions of said elongated strip.

4. A method of constructing the accessory of claim 1 comprising providing long and short pieces of towelling, superimposing said short piece on one end of said long piece and sewing said pieces together by stitching along the inwardly facing edge of said short piece, folding said towelling along the line of said stitching to provide three superimposed layers, two of said layers having superimposed free edges perpendicular to the longitudinal axis of said long piece of towelling, sewing said three layers together along their edges to provide inner and outer pockets, and turning said outer pocket inside out to leave pockets on opposite major surfaces of said long piece at said end.

5. The accessory of claim 1 wherein said pockets are spaced essentially equidistant from one end of said towelling whereby said casings are substantially superimposed on each other.

* * * * *